United States Patent [19]

Faiks

[11] Patent Number: 4,478,454

[45] Date of Patent: Oct. 23, 1984

[54] WEIGHT-ACTUATED CHAIR CONTROL

[75] Inventor: Frederick S. Faiks, Greenville, Mich.

[73] Assignee: Steelcase Inc., Grand Rapids, Mich.

[21] Appl. No.: 271,662

[22] Filed: Jun. 8, 1981

[51] Int. Cl.[3] ..... A47C 1/02

[52] U.S. Cl. ..... 297/316; 297/320; 297/328

[58] Field of Search ..... 297/300, 301, 304, 305, 297/316, 320, 321, 313

[56] References Cited

U.S. PATENT DOCUMENTS

| | | | |
|---|---|---|---|
| 2,272,980 | 2/1942 | McLellan et al. . | |
| 2,321,385 | 6/1943 | Herold | 297/305 X |
| 2,612,211 | 9/1952 | Gielow et al. . | |
| 2,615,496 | 10/1952 | Lorenz et al. . | |
| 2,760,556 | 8/1956 | Henrikson et al. . | |
| 2,796,918 | 6/1957 | Luckhardt . | |
| 3,139,305 | 6/1964 | Mizelle | 297/321 X |
| 3,356,413 | 12/1967 | Radke et al. . | |
| 3,386,770 | 6/1968 | Williams . | |
| 3,402,964 | 9/1968 | Williams . | |
| 3,537,674 | 11/1970 | Kobrehel . | |
| 3,602,537 | 8/1971 | Kerstholt . | |
| 3,740,792 | 6/1973 | Werner . | |
| 3,989,297 | 11/1976 | Kerstholt . | |
| 4,198,094 | 4/1980 | Bjerknes et al. | 297/328 |

*Primary Examiner*—Francis K. Zugel

*Attorney, Agent, or Firm*—Price, Heneveld, Huizenga & Cooper

[57] ABSTRACT

A body weight chair control in which the chair back and chair seat may be adjusted independently of each other. The chair occupant's body weight is the source of energy in moving both the back and seat. The chair control includes a front link and a rear link, each pivotally mounted on a base link. An intermediate link is pivotally mounted on the rear link, and a seat link is mounted on and between the intermediate link and the front link. A releasable locking mechanism is provided to lock two non-connected links in fixed relation, whereby all five links are locked in fixed relation.

5 Claims, 9 Drawing Figures

WEIGHT-ACTUATED CHAIR CONTROL

BACKGROUND OF THE INVENTION

The present invention relates to chair controls and, more specifically, chair controls which permit the chair back to be adjusted independently of the chair seat.

The present invention also relates to body weight chair controls in which the forces employed to adjust the chair back and chair seat are supplied by the user by shifting his or her weight within the chair.

In contrast, other common types of chair controls include a biased control attached only to the chair seat, such that the chair and back tilt at the same rate. An example of this type of construction is found in U.S. Pat. No. 3,386,770. This design has significant disadvantages partly due to the fact that the chair seat and chair back are maintained in fixed relationship regardless of the degree to which the chair is reclined. Furthermore, the configuration of the task, or fully forward, position of the chair cannot be varied. Consequently, the user may become fatigued as his body is maintained in one position while working for lengthy periods of time.

Other types of chair controls include synchrotilt chair controls in which the chair back and seat bolt tilt but at different rates to maintain a dynamic interrelationship between the seat and back. Examples of this type of chair control may be found in U.S. Pat. Nos. 2,796,918; 2,760,556; 2,615,496; and 2,612,211. Such chair controls also have significant drawbacks. First, although the inclination of the chair back relative to the chair seat is different for each reclined position of the chair, there is still only one chair back position for each seat position. Furthermore, neither the chair back nor the chair seat may be adjusted when the chair is in its task (i.e. fully forward) position.

Yet other prior art chair controls are attached only to the chair back, such that the back tilts but the seat does not. This type of control may be found for example in U.S. Pat. No. 2,272,980. This type of control also has serious drawbacks. First, the chair seat is not at all adjustable. Further, the position of the chair back cannot be varied when the chair is in its task position.

Body weight-actuated chair controls typically require complicated linkages for distributing the forces in the chair control so that no biasing means are required. The controls must be constructed so that the user's weight is somewhat evenly distributed throughout the chair, so that relatively slight shifts of body weight will result in movement or adjustment of the chair control.

One type of body weight chair control provides linkage between the back support and the seat support so that the seat is pushed forwardly and upwardly as the chair back is reclined. Examples of this type of control are shown in U.S. Pat. Nos. 2,796,918; 2,760,556; and 2,612,211. As with the earlier described dynamic chair controls, the angular relationship between the chair back and the chair seat cannot be varied, particularly when the chair is in its task position. Further, the angle of the chair seat in the task position cannot be adjusted.

Another type of body weight chair control pivots the chair seat and back precisely over the assembly's center of gravity. Consequently, a slight shift of weight by the user, not necessarily against the chair back, will result in movement of the chair control. An example of this type of control may be found in U.S. Pat. No. 2,615,496. This control is quite unstable because the center of gravity is so critically located and no biasing means are provided to alleviate the resultant instability of this location. Furthermore, there is only one chair back position for each angular orientation of the chair seat. Finally, the task position of this type of control may not be varied.

A further problem with all of the above-mentioned chair controls is that they are dynamic, rather than static, controls. Consequently, they do not generally lock and maintain one of the many possible configurations, a feature frequently desirable.

SUMMARY OF THE INVENTION

In recognition of the drawbacks and problems of the prior art, the chair control of the present invention permits both the chair back and the chair seat to be independently adjusted to a variety of configurations. Further, the chair back moves independently of the chair seat and vice versa. These features enable the user to adjust the chair control to reduce uncomfortable pressure points on the user's body and to reduce body fatigue. The chair control is of the static type, wherein the position of the chair back and chair seat are adjusted to suit an individual user and then locked in fixed relationship. Consequently, once the chair control has been adjusted to a desired configuration, it can be rigidly maintained in that relationship until one wishes to alter the adjustment. Furthermore, the chair control is body weight-actuated, so that biasing means are unnecessary which simplifies construction and reduces the cost of the chair control.

These desired features are provided by the structure of the present invention in which the chair control comprises five links pivotally mounted to one another. The links include a stationary link, front and rear links pivotally mounted thereto, and intermediate and seat links pivotally mounted to each other and to the rear and front links respectively. Additionally, in the preferred embodiment, locking means is provided for maintaining any two nonconnected links in fixed relationship whereby all five links are maintained in a desired configuration.

The links are configured so that the angular orientation of the chair back and the chair seat may be adjusted independently of one another. The relationship of the links also permits the control to be adjusted solely by shifts of the user's body weight, and consequently additional biasing means such as springs or torsion bars are unnecessary.

The chair links are oriented so that a downward force of the seat link urges that link forward. Consequently, the user's body weight exerted upon the seat link urges the chair seat forwardly. The orientation of the links is also such that a force exerted rearwardly on the chair back urges the seat link rearwardly. Consequently, the chair control is urged into a reclined position when one leans backward exerting force against the chair back.

These and other objects, advantages and features of the invention will be more fully understood and appreciated by reference to the following written description and accompanying drawings.

DETAILED DESCRIPTION OF THE PREFERRED EMBODIMENT

Figure 1:
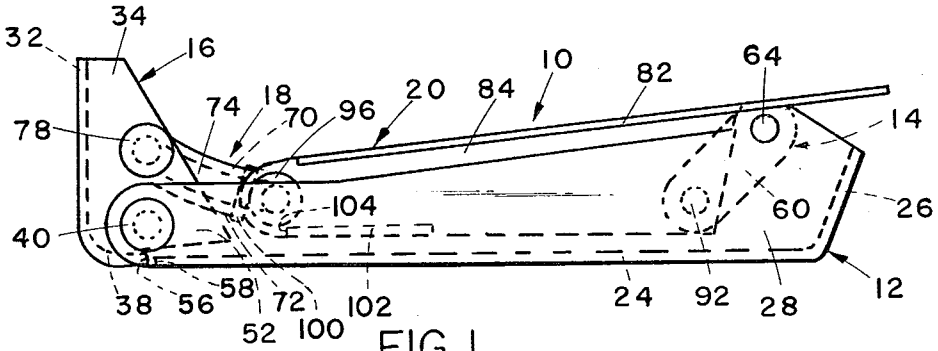
FIG. 1 is a right side elevational view of a chair control embodying the present invention shown with the locking mechanism removed.
Figure 5:
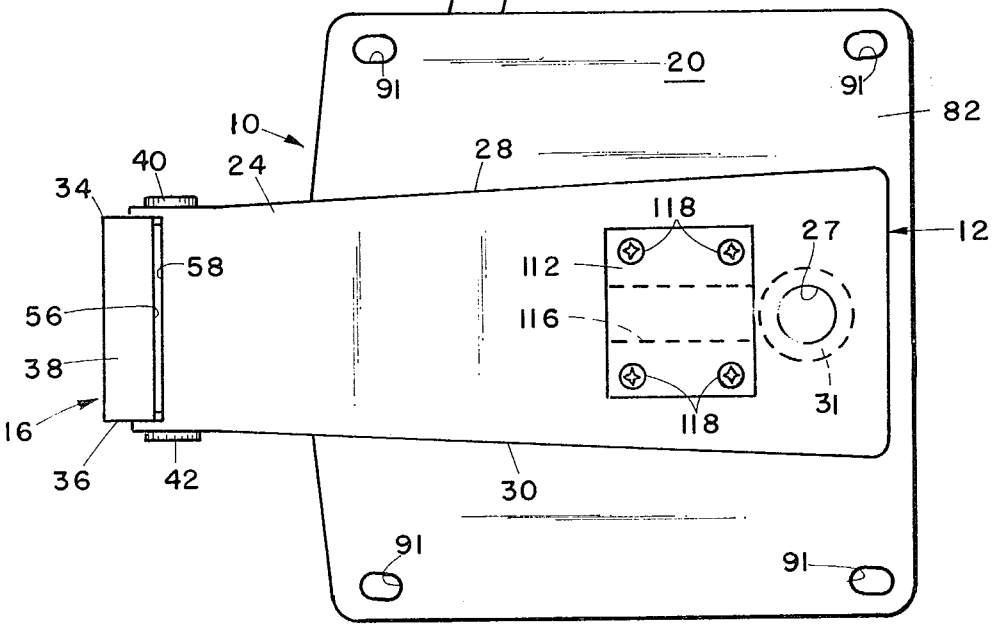
FIG. 5 is a bottom plan view of the chair control.

Chair control 10 generally comprises base link 12, front link 14, rear link 16, intermediate link 18, seat link 20, and locking mechanism 22. Base link 12 is oriented generally parallel to the floor and includes means for mounting control 10 on a chair base. Rear link 16 is pivotally connected at its lower portion to the rear portion of base link 12 and provides a means whereby a chair back (not shown) may be mounted on control 10. A rear portion of intermediate link 18 is pivotally connected to an upper portion of rear link 16 and at its forward portion to seat link 20. Seat link 20 includes structure for receiving a chair seat (not shown) and is mounted at its rear end to intermediate link 18 and at its front end to front link 14. Finally, front link 14 is connected at a first end to a forward portion of base link 12 and at a second end to seat link 20. Because of this unique five bar construction, the chair back and chair seat of the assembled chair may be adjusted independently of each other to obtain a desired seating position. When adjusting the tilt angle of the chair back, the chair seat angle can be maintained since seat link 20 is free to "float" to a variety of parallel positions as rear link 16 is pivoted due to pivotal link connections of seat link 20 at opposite ends to base link 12. Similarly, the seat angle can be adjusted as desired with or without adjusting the tilt angle of the back. The structure of the preferred embodiment which permits this control of adjustments is now described in detail.

Base link 12 includes a base pan 24, which is generally flat and parallel to the floor when control 10 is mounted on a chair base by mounting link 12 to a conventional chair iron in a conventional manner. A forward portion 26 of pan 24 extends upwardly and forwardly from pan 24 at approximately a 65° angle. Sidewalls 28 and 30 extend upwardly from either side of base pan 24 with the adjoining edges welded to complete the structure of base link 12. A spindle aperture 27 extends through base pan 24 providing a means whereby control 10 can be mounted on a chair base or iron. A spindle receiving support collar 31 is cylindrically shaped and welded on the upper surface of base pan 24 in alignment with aperture 27.

Pivotally mounted to one end of base link 12 is a rear link 16, which generally comprises a rear wall 32 and forwardly extending sidewalls 34 and 36 which extend generally in vertical planes. A floor portion 38 of rear wall 32 is formed so as to extend generally under and forwardly of rear wall 32 and the sidewalls with the adjoining edges of these link sections welded. When viewed from above (FIG. 2), rear link 16 thus is generally U-shaped with the distance between the outer surfaces of sidewalls 34 and 36 being substantially the same as the distance between the inner surfaces of sidewalls 28 and 30 of link 12.

A stud 40 extends through aligned apertures in sidewalls 28 and 34, and a stud 42 extends through aligned apertures in sidewalls 30 and 36. Inner ends 44 and 46 of studs 40 and 42 respectively are welded to sidewalls 34 and 36 to secure the studs in place. Rear link 16 is thus free to pivot about studs 40 and 42.

Figure 4:
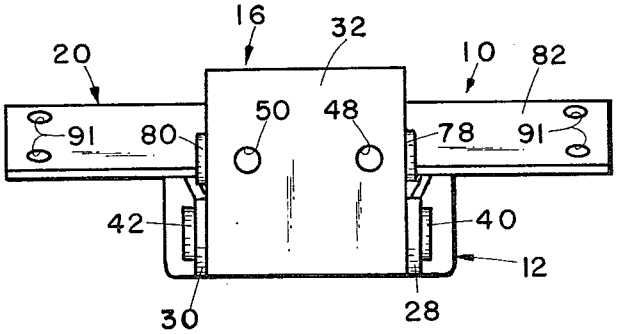
FIG. 4 is a rear elevational view of the chair control with the locking mechanism removed.

A pair of apertures 48 and 50 (FIG. 4) extend through outer wall 32 such that a chair back (not shown) may be installed to link 16 of the chair control and be moved forward or backward with pivotal movement of member 16 about studs 40 and 42. The degree of rotation of rear link 16 is limited in the forward direction when lower edges 52 and 54 of sidewalls 34 and 36 engage the floor of base pan 24 (FIG. 8) and in the rearward direction when the forward edge 56 of outer wall 32 engages rear edge 58 of base pan 24 (FIG. 9).

Figure 3:
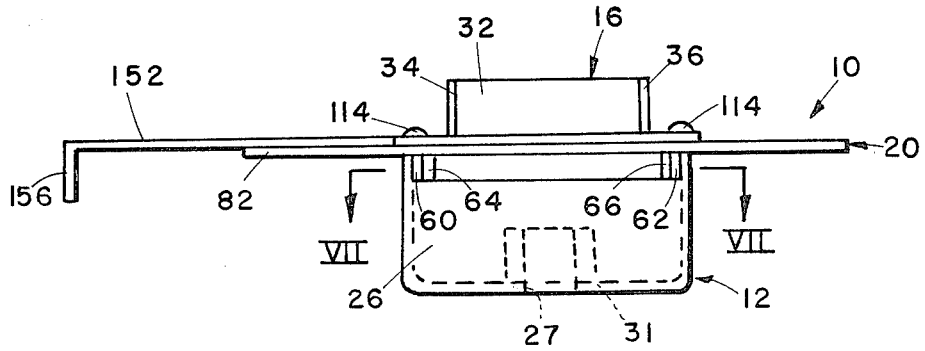
FIG. 3 is a front elevational view of the chair control with the locking mechanism removed.

Front link 14 comprises a pair of horizontally spaced front link plates 60 and 62 (FIG. 3) pivotally mounted at one end to link 12 by a stud 64 extending through front link plate 60 and sidewall 28 and a stud 66 extending through link plate 62 and sidewall 30. Studs 64 and 66 are held in position by welding stud ends 68 to sidewalls 28 and 30. When so mounted, front link 14 is free to pivot about studs 64 and 66. The opposite ends of link plates 60 and 62 are pivotally coupled to, and the degree of rotation of plates 60 and 62 about studs 64 and 66 is limited by their coupling to and the movement of, seat link 20 as will be described.

Figure 2:
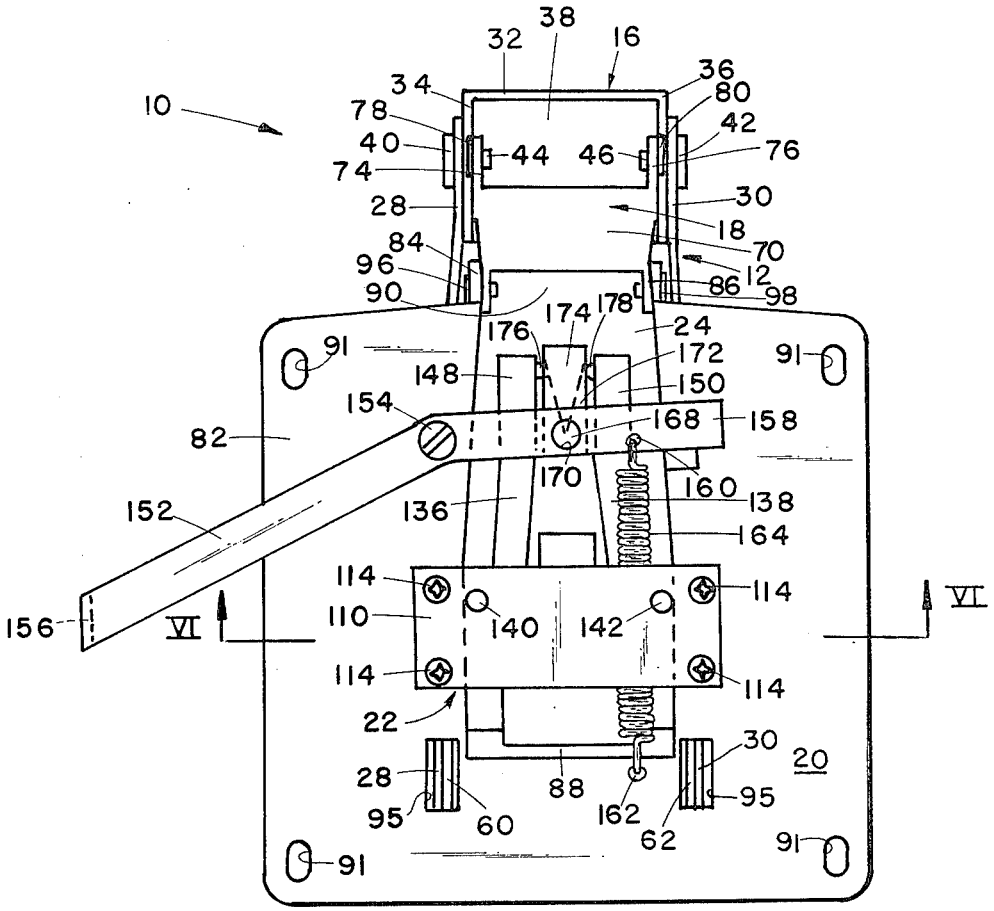
FIG. 2 is a top plan view of the chair control.
Figure 8:
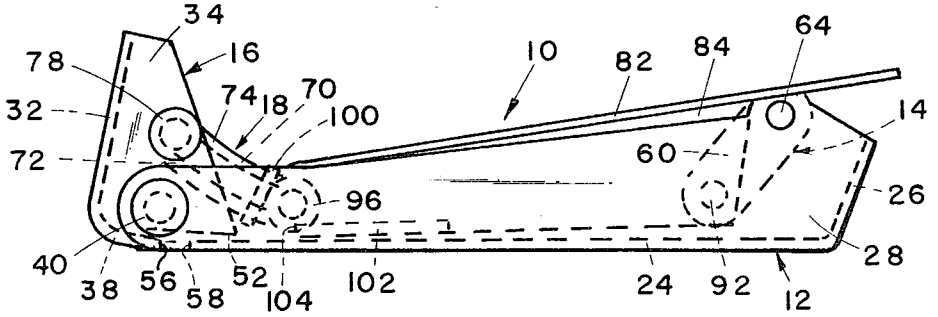
FIG. 8 is a right side elevational view of the chair control in its fully forward position and shown with the locking mechanism removed.
Figure 9:
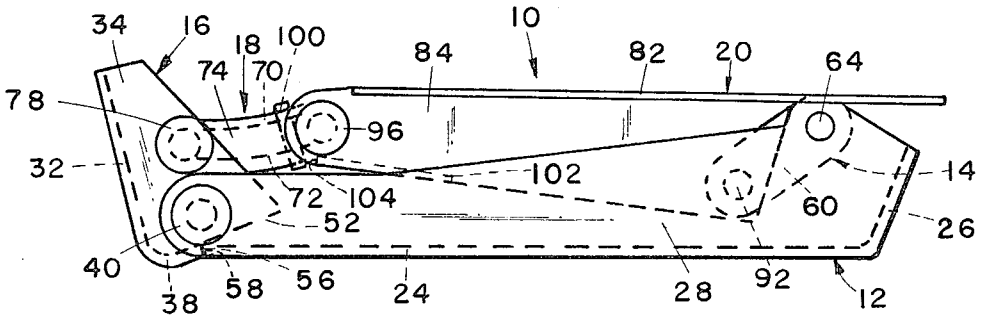
FIG. 9 is a side elevational view of the chair control in its fully rearward position and shown with the locking mechanism removed.

Intermediate link 18 as best seen in FIGS. 2 and 8 comprises an upper plate 70, lower plate 72 and sidewalls 74 and 76 extending therebetween. Plates 70 and 72 are arcuate in vertical cross section, and curved sidewalls 74 and 76 are generally parallel to one another, with the spacing between the outer surfaces of walls 74 and 76 generally the same as the spacing between the inner surfaces of walls 34 and 36 of link 16 to fit therebetween. A stud 78 passes through sidewall 34 and adjacent sidewall 74, and a stud 80 extends through adjacent sidewalls 36 and 76 to pivotally couple one end of link 18 to link 16 at a position spaced above the pivotal coupling of link 16 to link 12. Studs 78 and 80 are welded to sidewalls 74 and 76 to secure some in place, while intermediate link 18 is free to pivot about these studs.

The last of the five links in chair control 10 is seat link 20, which generally comprises a planar seat support 82 and downwardly extending sidewalls 84 and 86. Sidewalls 84 and 86 of link 20 extend generally perpendicularly and downwardly from seat support 82. The distance between the outer surfaces of sidewalls 84 and 86 at widest point 88 is substantially the same as the distance between the inner surfaces of sidewalls 60 and 62 of link 14. The distance between the inner surfaces of sidewalls 84 and 86 at narrowest point 90 is substantially the same as the distance between the outer surfaces of sidewalls 74 and 76 of link 18. Seat support 82 is notched inwardly from its rear edge to be U-shaped when viewed from above (FIG. 2). The cutout defining the U-shape provides clearance for the locking mechanism and tapers in width from its widest point 88 to its narrowest point 90. Four seat securing apertures 91 are located in seat support 82 so that a chair seat (not shown) may be secured to support 82. Apertures 95, which also extend through seat support 82, receive the upper portions of sidewalls 28 and 30 and link plates 60 and 62.

Seat link 20 is pivotally connected to front link 14 by a stud 92 extending through sidewall 84 and link plate 60 and a stud 94 extending through sidewall 86 and link plate 62. The ends of studs 92 and 94 are welded to sidewalls 84 and 86 to secure them in place. Seat link 20 is pivotally mounted at its rear end to intermediate link 18 by a stud 96 extending through sidewall 84 and sidewall 74, while stud 98 extends through sidewall 86 and sidewall 76. Studs 96 and 98 are welded to sidewalls 84 and 86 to secure them in place. When so installed, seat link 20 is free to pivot about studs 92 and 94 and also about studs 96 and 98.

A butt plate 100 is welded to the forward edges of upper and lower plates 70 and 72. Seat link plate 102 extends between sidewalls 84 and 86. Movement of studs 96 and 98 is limited in the upward direction when butt plate 100 engages rear edge 104 of seat link plate 102 (FIG. 9) and in the downward direction when seat support 82 engages sidewalls 28 and 30 (FIG. 8).

Figure 6:
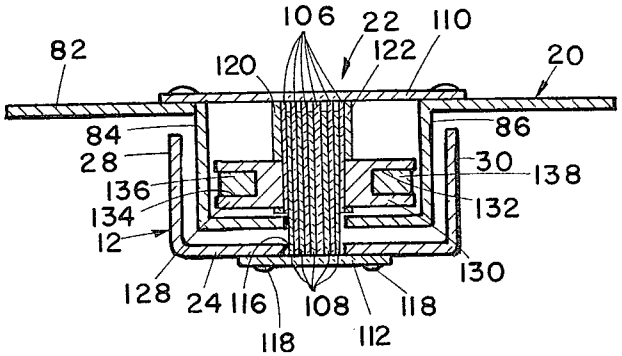
FIG. 6 is a cross-sectional view taken along plane VI—VI in FIG. 2.
Figure 7:
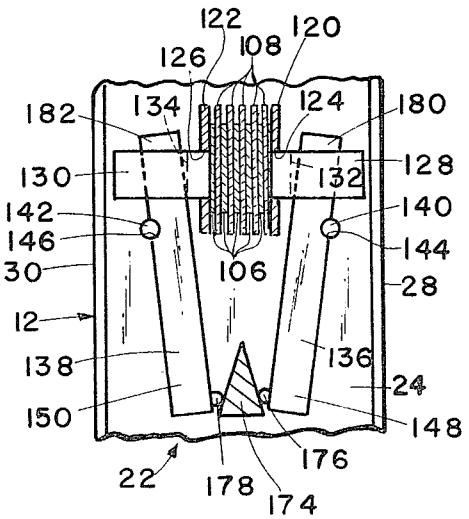
FIG. 7 is a cross-sectional view taken along plane VII—VII in FIG. 3.

The five links of chair control 10 are maintained in fixed relationship by locking any two non-connected links (i.e. not directly connected to one another) in fixed relationship. This locking is performed in the preferred embodiment between base link 12 and seat link 20 using locking mechanism 22. Turning specifically to FIGS. 2, 6 and 7, it is readily apparent that locking mechanism 22 is of the stacked plate type. Basically, locking mechanism 22 comprises a plurality of spaced seat link plates 106 securely mounted to seat link 20 and a plurality of spaced base link plates 108 extending upwardly from base link 12 interleaving with seat plates 106 and means for releasably locking plates 106 and 108 together.

Seat link plates 106 extend generally perpendicularly from a mounting plate 110 which is mounted on seat support 82 using screws 114. Similarly, base link plates 108 extend generally perpendicularly from a mounting plate 112. Base link plates 108 are inserted through plate aperture 116 in base link 12 and secured in position by fastening mounting plate 112 to base pan 24 using screws 118. When plates 106 and 108 are installed in this manner, they interleave as most clearly shown in FIGS. 6 and 7. When no external pressure is applied, the plates do not engage one another and thus are free to move relative to one another so that seat link 20 may move independently of base link 12.

Piston plates 120 and 122 also extend generally perpendicularly from mounting plate 110 and lie substantially adjacent the two outermost seat link plates 106. Circular piston apertures 124 and 126 extend through piston plates 120 and 122, respectively. Located within piston apertures 124 and 126 are pistons 128 and 130 which are generally cylindrically shaped bodies. When pistons 128 and 130 are forced toward each other, plates 106 and 108 bend slightly and are compressively locked together thereby maintaining seat link 20 and base link 12 in fixed relation. However, when no force is exerted on pistons 128 and 130, plates 106 and 108 are again free to move relative to one another, permitting adjustment of the chair control.

Diametric slots 132 and 134 extend through pistons 128 and 130, respectively. Located within slots 132 and 134 are levers 136 and 138 which extend rearwardly in control 10. Posts 140 and 142 extend downwardly from plate 110 and abut base pan 24. Notches 144 and 146 are cut into levers 136 and 138, respectively, to engage posts 140 and 142. This engagement helps maintain levers 136 and 138 in position within control 10.

Lever 152 is pivotally mounted to seat support 82 by a screw 154 and terminates at its outer end in a downwardly depending handle 156. Opposite handle 156 is spring end 158 having aperture 160 passing therethrough. Aperture 162 extends through seat support 82 forward of aperture 160. A coil spring 164 extends between and is hooked at either end to apertures 160 and 162. Consequently, spring end 158 of lever 152 is urged forwardly, and handle 156 is urged rearwardly.

Extending downwardly from and pivotally mounted to lever 152 is wedge block 166. Pin 168 extends upwardly from wedge block 166 and is pivotally mounted within aperture 170 in lever 152. Wedge device 166 comprises a rectangular upper portion 172 and a wedge-shaped lower portion 174. Wedge 174 is positioned between rearmost ends 148 and 150 of levers 136 and 138, respectively. Knobs 176 and 178 extend from levers 136 and 138, respectively, to engage wedge 174.

Forward motion of wedge 174 urges rearmost ends 148 and 150 outwardly and away from each other. Consequently, levers 136 and 138 pivot about posts 140 and 142, respectively, and piston ends 180 and 182 of levers 136 and 138, respectively, are urged toward each other forcing pistons 128 and 130 together, thereby locking the stacked plate locking mechanism 22. When wedge 174 is moved rearwardly, rearmost ends 148 and 150 are free to move toward each other, releasing the pressure on pistons 128 and 130, thereby releasing lock mechanism 22.

OPERATION

Adjustment of chair control 10 to a desired configuration is accomplished rapidly and easily. One seated upon a chair incorporating control 10 first grasps handle 156 and moves same forwardly. Lever 152 pivots about screw 154 thereby moving wedge 174 rearwardly. Consequently, levers 136 and 138 cease to urge pistons 128 and 130 toward each other, and stacked plate locking mechanism 122 is released.

The user then shifts his weight upon the chair seat so that seat link 20 is oriented at a comfortable angle. The extremes of the movement of seat link 20 are shown in FIGS. 8 and 9 which show the link inclined fully rearward and fully forward, respectively. While maintaining the desired angular orientation of seat link 20, the user next adjusts rear link 16 by moving the chair back. Rear link 16 may be pivoted rearwardly by exerting pressure rearwardly against the chair back and pivoted forwardly by grasping the chair back and puling the same forward. Because seat link 20 is pivoted at both its front and rear ends, it is possible to maintain the desired angular orientation of seat link 20 even though rear link 16 and consequently intermediate link 18 are being adjusted.

When the desired chair control configuration has been obtained, handle 156 is released, and spring 164 urges spring end 158 of lever 152 forwardly. Consequently, wedge 174 is also drawn forward forcing rearmost ends 148 and 150 away from each other. Levers 136 and 138 pivot about posts 140 and 142 and exert inward force on pistons 128 and 130. As the pistons are forced toward each other, plates 106 and 108 are also forced together, thereby locking mechanism 22. Seat link 20 is thereby maintained in fixed relationship to base link 12 by mechanism 22 extending therebetween. Consequently, the four pivot points associated with seat link 20 and base link 12 are also maintained in fixed relationship. The fifth pivot point, i.e. between rear link 16 and intermediate link 18, cannot move, and the entire control 10 is rigidly held in position. When one desires to adjust the chair control to a different configuration, he merely repeats the above process.

The chair of the preferred embodiment can be adjusted to an infinite number of task positions by the user. Furthermore, the task position may be varied by independently adjusting both the chair back and the chair seat. Because of this improved adjustability, the chair control is more comfortable and less fatiguing than prior art chair controls.

Furthermore, because the chair is body weight actuated, there is no need for additional biasing means to assist in movement of the chair control. This results in a simplified construction which is relatively inexpensive.

Finally, because one lock maintains both the chair back and the chair seat in position, the control is extremely easy to adjust. The user need only move a single lever forward, adjust the seat, and release the lever to change the position of the chair. Furthermore, this adjustment can be made while the user remains seated in his chair.

Of course, it is understood that the above is merely a preferred embodiment of the invention and that various changes and alterations can be made without departing from the spirit and scope of the invention as defined in the appended claims.

The embodiments of the invention in which an exclusive property or privilege is claimed are defined as follows:

1. A chair control which permits independent adjustment of the seat and back angles comprising:

a housing including means for receiving a chair base;

means for supporting a chair back;

first means pivotally mounting said chair back support means to said housing for permitting said chair back to tilt;

a front link;

second means pivotally mounting said front link to said housing;

an intermediate link;

third means pivotally mounting said intermediate link to said chair back support means, said third pivotal mounting means located upwardly from said first pivotal mounting means;

means for supporting a chair seat;

fourth means pivotally mounting said chair seat support means to said front link, said fourth pivotal mounting means located rearwardly and downwardly from said second pivotal mounting means;

fifth means pivotally mounting said chair seat support means to said intermediate link, whereby said chair seat can tilt independently of said chair back; and locking means for selectively maintaining said chair seat support means in fixed relation to said stationary housing.

2. The chair control of claim 1 further comprising means for limiting the rotation of said chair back support means about said first pivotal mounting means between a rearwardmost or reclined position and a forwardmost or task position.

3. The chair control of claim 2 wherein said locking means is mounted to and between said stationary housing and said chair seat support means.

4. The chair control of claim 3 wherein said locking means comprises a stacked plate lock.

5. The chair control of claim 2 further comprising means for limiting movement of said fifth pivotal mounting means between an uppermost position and a lowermost position.

* * * * *